United States Patent [19]

Bischof

[11] Patent Number: 4,625,868

[45] Date of Patent: Dec. 2, 1986

[54] COMPOSITE SLAT FOR USE IN VENETIAN BLINDS

[75] Inventor: Richard Bischof, Hölstein, Switzerland

[73] Assignee: Emil Schenker AG, Schönenwerd, Switzerland

[21] Appl. No.: 701,637

[22] Filed: Feb. 14, 1985

[30] Foreign Application Priority Data

Feb. 23, 1984 [CH] Switzerland ..... 890/84

[51] Int. Cl.[4] ..... E06B 9/26; E06B 9/264

[52] U.S. Cl. ..... 206/577; 160/166 R; 160/178 R; 206/326

[58] Field of Search ..... 206/577, 321, 326, 582; 160/168 R, 178 R, 166 R

[56] References Cited

U.S. PATENT DOCUMENTS

| | | | |
|---|---|---|---|
| 1,949,653 | 3/1934 | Moore | 160/168 R |
| 2,120,593 | 6/1938 | Reynolds | 206/326 |
| 2,152,117 | 3/1939 | Wade et al. | 160/168 R |
| 2,723,716 | 11/1955 | Berni | 160/168 R |
| 2,784,780 | 3/1957 | Evans | 160/178 R |
| 2,822,083 | 2/1958 | Horne et al. | 206/326 |
| 3,086,586 | 4/1963 | Wolfe | 160/178 R |
| 3,916,973 | 11/1975 | Schuppler et al. | 160/178 R |
| 4,475,579 | 10/1984 | Bassett | 160/178 R |

FOREIGN PATENT DOCUMENTS

| | | | |
|---|---|---|---|
| 104703 | 6/1966 | Denmark | 160/178 R |
| 1659463 | 10/1969 | Fed. Rep. of Germany | 160/168 R |
| 2491540 | 4/1982 | France | 160/166 R |
| 6409755 | 2/1966 | Netherlands | 160/166 R |

*Primary Examiner*—William Price
*Assistant Examiner*—Brenda J. Ehrhardt
*Attorney, Agent, or Firm*—Peter K. Kontler

[57] ABSTRACT

A prefabricated kit for the assembly of a composite slat which can be used in a venetian blind has two or more elongated first slat sections which can be separably coupled to each other by one or more connecting slat sections. The end portions of the connecting slat sections can be slidably telescoped into the adjacent end portions of neighboring first slat sections or vice versa. At least one outer slat section, which is one of the first slat sections, can be assembled of two shorter sections one of which carries a longitudinally outwardly extending guide pin for reception in a guide rail in the door or window opening wherein the venetian blind utilizing the slat is installed with its slats in vertical or horizontal positions. The connecting slat sections have apertures for the gathering tape or cord which is used to move the neighboring slats of a blind nearer to each other or to permit their movement away from one another.

11 Claims, 1 Drawing Figure

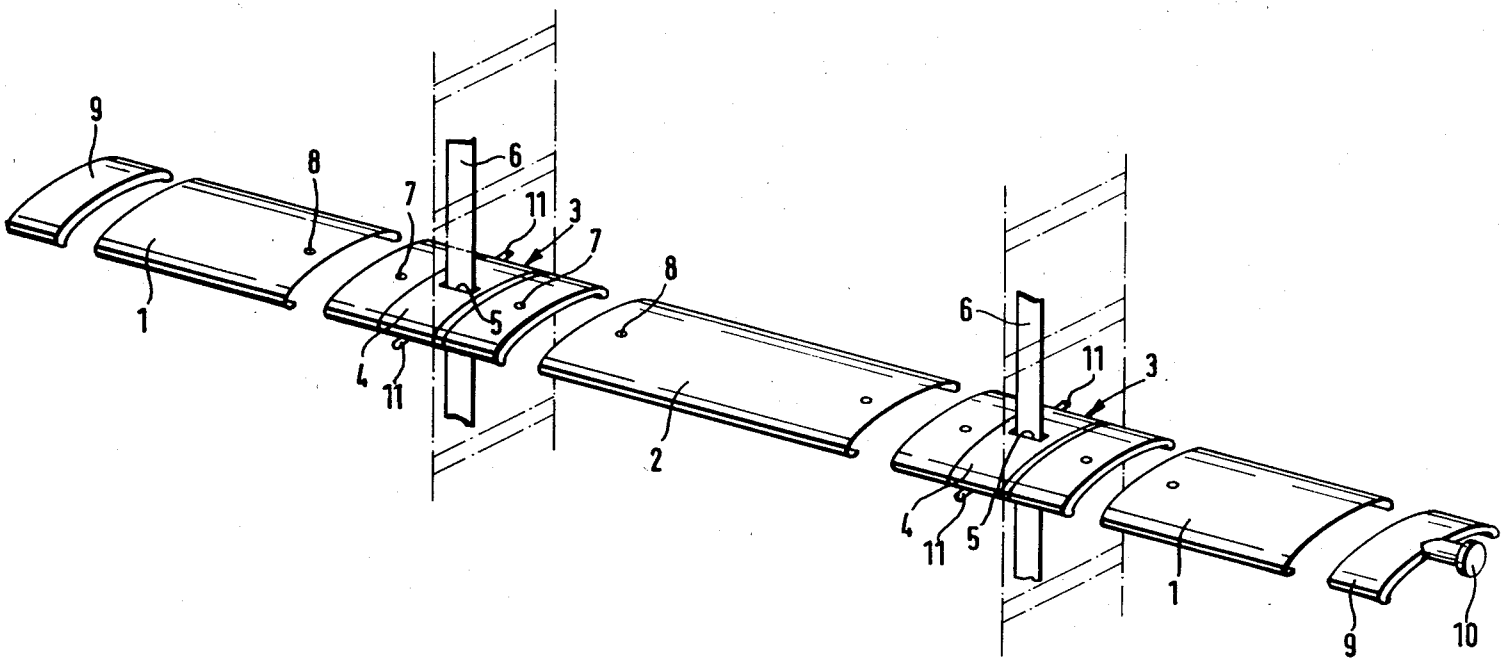
10
9
1
3
11
6
5
11
4
2
8
7
3
11
6
5
7
11
4
8
1
9

COMPOSITE SLAT FOR USE IN VENETIAN BLINDS

BACKGROUND OF THE INVENTION

The present invention relates to slats for venetian blinds and analogous closures in general, and more particularly to improvements in slats which can be assembled with identical or similar slats into blinds wherein the slats extend vertically or horizontally.

Slats for use in venetian blinds are normally cut to size in the manufacturing plant. In order to ensure that the blind will have slats of optimum length, it is necessary to know the dimensions of the window or door in advance, i.e., such slats cannot be prefabricated in large numbers except possibly in one or more standard sizes which are customary in a particular country or in a particular part of a country. If the width or height of a window or door (depending upon the selected orientation of slats in the venetian blind) is not a popular width or height, the slats cannot be mass-produced in advance but only after receipt of an order specifying the dimensions of the windows and/or doors which are to be equipped with venetian blinds. Cutting elongated blanks of coherent slats to size at the locale of intended use or assembly of venetian blinds is a tedious operation because large supplies of coherent blanks must be shipped from the plant or maintained in a state of readiness at the store of a wholesaler or retailer. Moreover, it is necessary to keep handy suitable severing instrumentalities which can subdivide a blank of coherent slats into slats of prescribed length. The cutting of prefabricated slats to size at the locale of use by trimming often produces much waste in the material of the slats.

OBJECTS AND SUMMARY OF THE INVENTION

An object of the invention is to provide a novel and improved prefabricated slat which can be used in venetian blinds and whose effective length can be selected and/or altered with little loss in time and with little or no waste in the material of the slat.

Another object of the invention is to provide a novel and improved kit which can be assembled into a slat of desired length.

A further object of the invention is to provide a kit, which can be assembled into a finished slat such as is ready for installation in the opening of a window or door, with one or more apertures for the passage of gathering tapes or cords and means for fixing the orientation changing elements to the slat.

An additional object of the invention is to provide a novel and improved method of assembling a composite slat for use in venetian blinds and the like.

Another object of the invention is to provide a composite slat whose constituents can be assembled into shorter, longer or medium long slats.

Still another object of the invention is to provide a kit which can be assembled into slats of optimum length without resorting to any tools or by resorting to rudimentary or readily available tools.

A further object of the invention is to provide a composite slat which can be used in existing venetian blinds as a substitute for a damaged or destroyed slat.

Another object of the invention is to provide a slat which can be readily taken apart and one or more of its constituents reused in other slats or for the assembly of shorter or longer slats.

The improved kit is used for the assembly of a composite slat which can be used in a venetian blind or a like structure. The kit comprises at least two elongated first slat sections and at least one connecting slat section which can be placed between the first sections. The first and connecting sections respectively have first and second end portions which can be slidably telescoped into each other. The kit can comprise at least three first sections and at least two connecting sections which alternate with the first sections. The first sections can include two outer or end sections and an intermediate section. A connecting section can be placed between each end portion of the intermediate section and the respective end section to separably but reliably couple the intermediate section to the two end sections. At least one of the first sections, especially one of the two outer or end sections, can include a guide pin which extends longitudinally of and beyond one end of the one first section. Such one first section can be assembled of telescopically connected shorter sections one of which carries the guide pin. Each connecting section can be provided with at least one aperture (e.g., an elongated slot extending longitudinally of the assembled slat) for the passage of a flexible slat gathering element in the form of a tape or cord.

The end portions of each connecting section can be received in the adjacent end portions of neighboring first sections or vice versa. Each connecting section can be further provided with fastener means (e.g., one or more hooks or the like) for attachment of a cord thereto, e.g., a cord which is used to change the inclination or orientation of the slat.

Cooperating male and female detents can be provided on the first sections and on the connecting section or sections to prevent accidental separation of neighboring sections. The female detents can include sockets in the connecting section or sections and the male detents then comprise protuberances provided on the first sections and arranged to snap into the sockets of the adjacent connecting section or sections. Each connecting section can be provided with a stop which determines the extent to which the corresponding first section or sections can be telescopically connected therewith. At least the first sections have or can have substantially concavo-convex profiles.

The novel features which are considered as characteristic of the invention are set forth in particular in the appended claims. The improved kit itself, however, both as to its construction and the mode of assembling the same, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is an exploded perspective view of a composite slat which is or can be assembled of three first sections and two connecting sections, and further showing portions of flexible gathering elements and portions of additional flexible elements which can be used to change the inclination of slats in a venetian blind.

DESCRIPTION OF THE PREFERRED EMBODIMENTS

Referring to the drawing in detail, there is shown a kit which can be assembled into a composite slat of the type suitable for use in a venetian blind. The illustrated kit is composed of three first sections including two outer or end sections 1 and an intermediate section 2, and two connecting sections 3 each of which can serve to connect one end portion of the intermediate section 2 to one end portion of the respective outer section 1. The sections 1 and 2 have the accustomed concavo-convex profiles with the longitudinal marginal portions bent over to reduce the likelihood of injury. Each of the connecting sections 3 has a slightly raised or offset median portion 4 which constitutes a stop serving to determine the extent to which the end portions of the respective connecting section 3 can be slidably telescoped into the adjacent end portions of the respective outer section 1 and the intermediate section 2. Each raised median portion or stop 4 has a centrally located aperture 5 in the form of a slot extending longitudinally of the assembled slat and providing a path for the passage of a gathering tape or cord 6. The dimensions of the raised median portions or stops 4 are preferably selected in such a way that the convex upper sides of such raised portions are at least substantially flush with the convex upper sides of the adjacent sections 1 and 2 when the sections 1, 2 and 3 are assembled with each other to form a slat of desired length. If the slat is too long, the one or the other end portion of the intermediate section 2 can be trimmed in addition to or in lieu of removal of material from those end portions of the outer sections 1 which are to receive the adjacent end portions of the respective connecting sections 3. If the slat is too short, the illustrated intermediate section 2 is simply replaced with a longer section and/or the illustrated outer sections 1 are replaced with longer sections. The sections 1, 2 and 3 are held in assembled condition by friction which prevails between the internal surfaces of the end portions of the sections 1, 2 and the external surfaces of the end portions of the respective sections 3. In addition, the improved kit can be provided with male and female detents to further reduce the likelihood of accidental separation of neighboring sections from each other. In the illustrated embodiment, the end portions of each of the connecting sections 3 have female detents in the form of sockets 7 and the end portions of the sections 1 and 2 have male detents in the form of protuberances 8 which can snap into the adjacent sockets 7 of the corresponding connecting sections 3.

Each of the outer sections can be assembled of two shorter sections, namely from a section 1 and a section 9 which latter can be slidably telescoped into the adjacent end portion of the respective section 1. One of the shorter sections 9 carries a guide pin 10 which extends into the groove of a customary guide rail when the illustrated kit is assembled into a slat of desired length and is used with several similar slats as a part of a venetian blind. The shorter sections 9 can be made of a suitable synthetic plastic material and can be slidably received in the corresponding guide rails in the opening of a door or window. The material of the shorter sections 9 can be selected with a view to reduce noise when the sections 9 slide in the corresponding guide rails as well as to reduce the likelihood of corrosion.

If the shorter sections 9 are omitted, the guide pin 10 is provided directly on the corresponding section 1.

The assembled slat can be mounted in the corresponding compartments of ladder-like orientation or inclination changing devices which are indicated by broken lines. Such orientation or inclination changing devices can be replaced with cords or analogous flexible elements which are separably attached to fastening devices in the form of hooks 11 provided along the marginal portions of the connecting sections 3.

If the end portions of or the entire connecting sections 3 are hollow, the end portions of the adjacent sections 1 and 2 can be slidably telescoped into the respective end portions of such hollow connecting sections.

In its most elementary form, the kit can be furnished with two first sections (e.g., the sections 1 with or without sections 9) and a single connecting section 3.

An important advantage of the improved kit is that the final length of the assembled slat can be determined at the locale of use by removing portions of both sections 1 and/or a portion of the section 2 (if the slat is too long) or by replacing the section 2 and/or the sections 1 with longer sections. The improved kit can be sold by do-it-yourself stores, by hardware stores, by department stores or other outlets and can also be used as a convenient replacement for a slat in an existing venetian blind. A store need not maintain a large number of different kits because each of the composite slats can be readily trimmed to the desired size with little loss in the material of the sections 1 and/or 2.

Each kit can be supplied with a suitable trimming tool.

The constituents of the illustrated kit can be used with the constituents of other kits, i.e., the individual parts of each kit can be used with individual parts of other kits to allow for the assembly of slats of required length and/or to effect minor or even major repairs of slats in assembled venetian blinds.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A kit for the assembly of a composite slat for use in a venetian blind, comprising at least three elongated first slat sections and at least two connecting sections arranged to be placed between said first sections so that said connecting sectiona alternate with said first sections and each connecting section is flanked by two first sections, said first and connecting sections respectively having first and second end portions arranged to be slidably telescoped into each other, each of said connecting sections having an aperture for the passage of a flexible slat gathering element and each connecting section further having fastener means for attachment of a cord thereto and stop means for determining the extent to which such connecting section can be coupled with the respective first sections.

2. The kit of claim 1, wherein said first sections include two outer sections and an intermediate section, said connecting sections being arranged to separably couple the end portions of said intermediate section to said outer sections.

3. The kit of claim 1, wherein at least one of said first sections includes a guide pin extending longitudinally of and beyond one end of said one section.

4. The kit of claim 3, wherein said one section includes two telescopically connected shorter sections and said guide pin is provided on one of said shorter sections.

5. The kit of claim 1, wherein the end portions of said connecting section are receivable in the end portions of said first sections.

6. The kit of claim 1, wherein the end portions of said first sections are receivable in the end portions of said connecting sections.

7. The kit of claim 1, wherein each of said fastener means comprises a hook.

8. The kit of claim 1, wherein said first sections include two outer sections at least one of which includes two shorter sections which are slidably telescoped into each other, and further comprising a guide pin provided on one of said shorter sections.

9. The kit of claim 1, further comprising cooperating male and female detents provided on said first and connecting sections.

10. The kit of claim 9, wherein the female detents are provided on said connecting sections.

11. The kit of claim 1, wherein at least said first sections have concavo-convex profiles.

* * * * *